US005669829A

United States Patent [19]

Lin

[11] Patent Number: 5,669,829

[45] Date of Patent: Sep. 23, 1997

[54] GOLF CLUB HEAD

[75] Inventor: Hai-Sheng Lin, Kaohsiung Hsien, Taiwan

[73] Assignee: Pro Saturn Industrial Corporation, Taiwan

[21] Appl. No.: 688,922

[22] Filed: Jul. 31, 1996

[51] Int. Cl.[6] ..... A63B 53/04

[52] U.S. Cl. ..... 473/346; 473/342

[58] Field of Search ..... 473/342, 345, 473/346, 330

[56] References Cited

U.S. PATENT DOCUMENTS

| | | | |
|---|---|---|---|
| 5,106,094 | 4/1992 | Desbiolles et al. | 473/342 |
| 5,294,037 | 3/1994 | Schmidt | 473/345 X |
| 5,303,922 | 4/1994 | Lo | 473/330 |
| 5,433,440 | 7/1995 | Lin . | |
| 5,564,994 | 10/1996 | Chang | 473/342 |

*Primary Examiner*—Raleigh W. Chiu
*Attorney, Agent, or Firm*—Banner & Witcoff, Ltd.

[57] ABSTRACT

A golf club head includes a face plate and a head body. The face plate is made of a first metal material and has a front side which serves as a hitting surface, and a rear side which is provided with a plurality of angularly spaced positioning pieces that extend radially outward from a peripheral edge of the face plate. The rear side of the face plate is further provided with a plurality of elongated reinforcing strips, each of which has a rearwardly protruding intermediate curved portion. The head body is made of a second metal material which has a melting point that is lower than that of the first metal material. The head body has a front portion with a front surface. The face plate is embedded in the front portion of the head body such that the hitting surface of the face plate is flush with the front surface of the front portion. The head body encloses each of the positioning pieces and the reinforcing strips during molding of the head body to result in a durable connection between the head body and the face plate.

5 Claims, 3 Drawing Sheets

GOLF CLUB HEAD

BACKGROUND OF THE INVENTION

1. Field of the Invention

The invention relates to a golf club head, more particularly to a golf club head which includes a head body and a face plate that are made of different metal materials and that are connected securely to each other when the head body is formed in a mold.

2. Description of the Related Art

Metal materials are used extensively in the fabrication of golf club heads. Presently, titanium is the best metal material for forming golf club heads in view of its excellent impact properties. However, titanium is quite expensive. As such, there is always a need to provide an improved golf club head which minimizes the use of titanium while maintaining the good impact properties of the golf club head.

SUMMARY OF THE INVENTION

Therefore, the object of the present invention is to provide a golf club head which includes a head body and a face plate that are made of different metal materials and that are connected securely to each other when the head body is formed in a mold.

According to the present invention, a golf club head includes a face plate and a head body. The face plate is made of a first metal material and has a front side which serves as a hitting surface, and a rear side which is provided with a plurality of angularly spaced positioning pieces that extend radially outward from a peripheral edge of the face plate. The rear side of the face plate is further provided with a plurality of elongated reinforcing strips, each of which has a rearwardly protruding intermediate curved portion. The head body is made of a second metal material which has a melting point that is lower than that of the first metal material. The head body has a front portion with a front surface. The face plate is embedded in the front portion of the head body such that the hitting surface of the face plate is flush with the front surface of the front portion. The head body encloses each of the positioning pieces and the reinforcing strips during molding of the head body to result in a durable connection between the head body and the face plate.

The reinforcing strips may be disposed in one of a horizontal, a vertical and an inclined direction. At least one of the reinforcing strips has distal ends that extend radially outward from the peripheral edge of the face plate. Preferably, the positioning pieces and the reinforcing strips are welded onto the rear side of the face plate, and a hosel is welded to the rear side of the face plate before the head body is formed.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
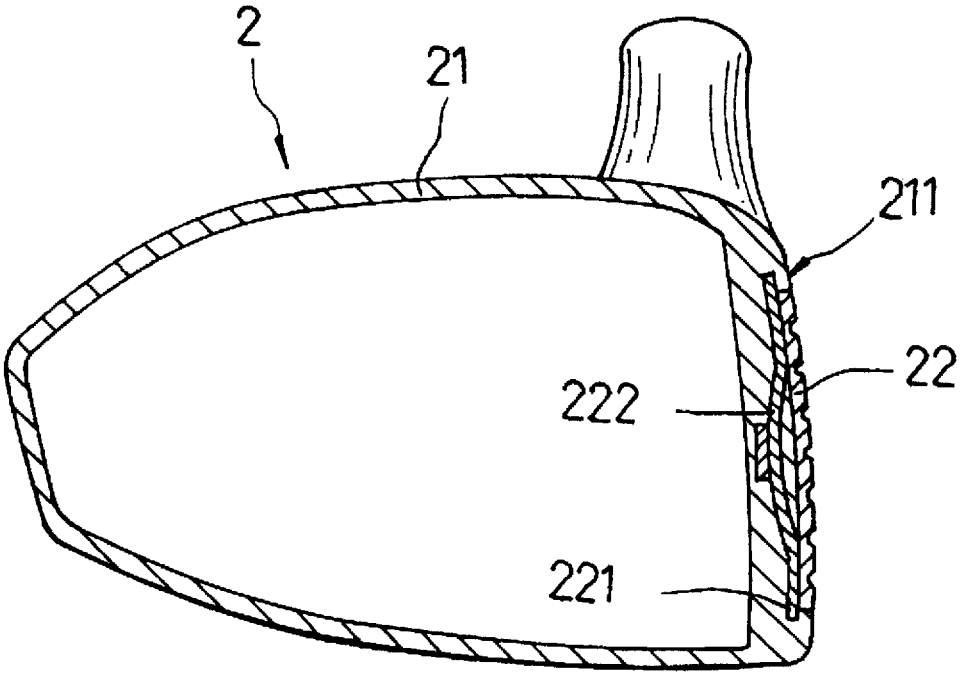
FIG. 1 is a sectional view showing the first preferred embodiment of a golf club head according to the present invention.
Figure 2:
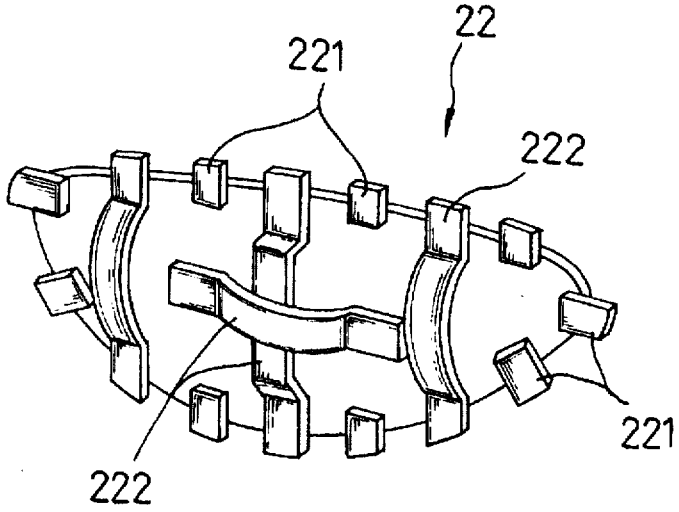
FIG. 2 is a rear perspective view of a face plate of the first preferred embodiment.

Referring to FIG. 1, the first preferred embodiment of a golf club head 2 according to the present invention is shown to comprise a head body 21 which has a front portion 211 with a front surface, and a face plate 22 which has a front side that serves as a hitting surface and which is embedded in the front portion 211 such that the hitting surface of the face plate 22 is flush with the front surface of the front portion 211. As shown in FIG. 2, the face plate 22 has a rear side which is provided with a plurality of angularly spaced positioning pieces 221 that extend radially outward from a peripheral edge of the face plate 22. The rear side of the face plate 22 is further provided with a plurality of elongated reinforcing strips 222, each of which has a rearwardly protruding intermediate curved portion. The reinforcing strips 222 may be disposed in one of a horizontal, a vertical and an inclined direction. In this embodiment, three of the reinforcing strips 222 are disposed in the vertical direction, while one of the reinforcing strips 222 is disposed in the horizontal direction. Preferably, some of the reinforcing strips 222 have distal ends that extend radially outward from the peripheral edge of the face plate 22. The positioning pieces 221 and the reinforcing strips 222 are welded onto the rear side of the face plate 22.

The face plate 22 is made of a first metal material, such as titanium, while the head body 21 is made of a second metal material which has a melting point that is lower than that of the first metal material. Thus, when fabricating the golf club head 2, the face plate 22 is initially formed and is then disposed in a mold (not shown) for forming the head body 21. The second metal material is subsequently poured into the mold such that, when the second metal material cools, the head body 21 with the front portion 211 which has the face plate 22 embedded therein can be formed, thereby completing the golf club head 2. Since the head body 21 encloses each of the positioning pieces 221 and the reinforcing strips 222, a durable connection between the head body 21 and the face plate 22 can be achieved.

Figure 3:
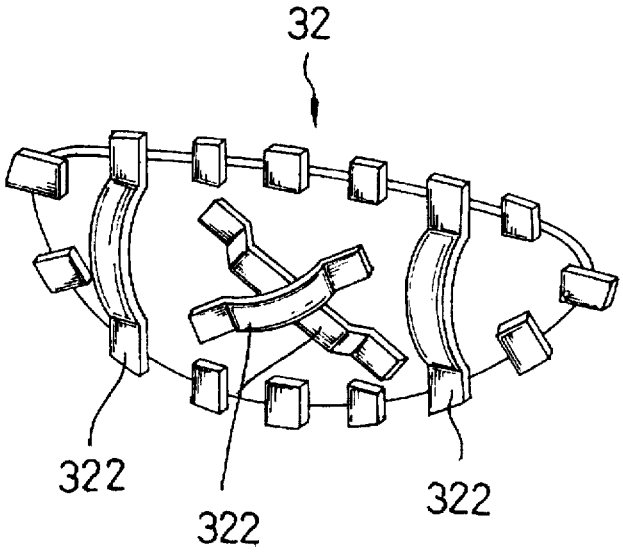
FIG. 3 is a rear perspective view of a face plate of the second preferred embodiment of a golf club head according to the present invention.

FIG. 3 illustrates the face plate 32 of the second preferred embodiment of a golf club head according to the present invention. The face plate 32 is substantially similar to that of the previous embodiment except that, in this embodiment, there are two reinforcing strips 322 disposed in the vertical direction. Two other reinforcing strips 322 are disposed in inclined directions and form a cross-shaped structure.

Figure 4:
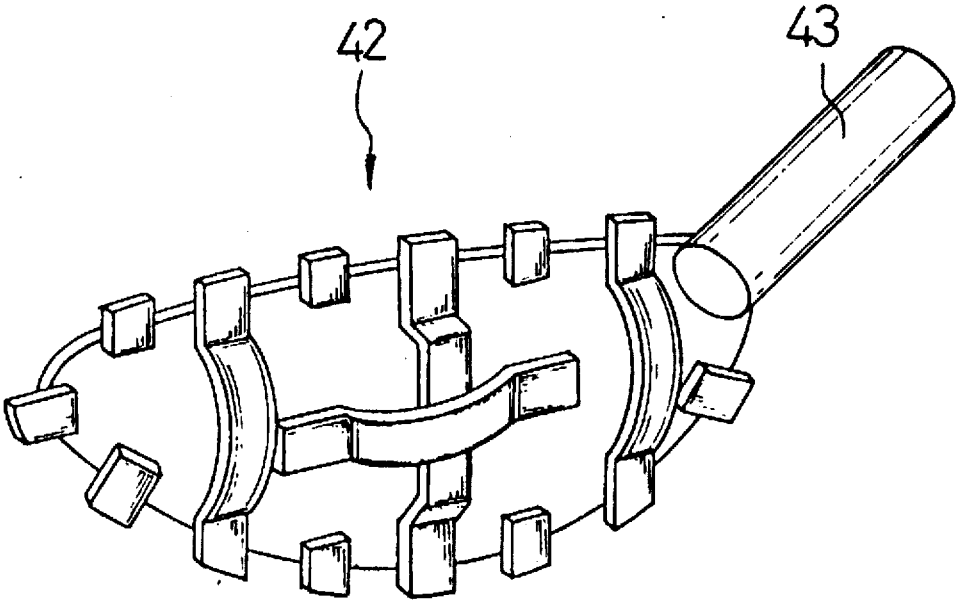
FIG. 4 is a rear perspective view of a face plate of the third preferred embodiment of a golf club head according to the present invention.

FIG. 4 illustrates the face plate 42 of the third preferred embodiment of a golf club head according to the present invention. The face plate 42 is substantially similar to that of the first embodiment. However, in this embodiment, a hosel 43 is welded to the rear side of the face plate 42 prior to the formation of the head body (not shown). Thus, the hosel 43 can be connected securely and conveniently in the golf club head of this embodiment.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A golf club head comprising:

a face plate made of a first metal material and having a front side which serves as a hitting surface, and a rear side which is provided with a plurality of angularly spaced positioning pieces that extend radially outward from a peripheral edge of said face plate, said rear side of said face plate being further provided with a plurality of elongated reinforcing strips, each of which has a rearwardly protruding intermediate curved portion; and a head body made of a second metal material which has a melting point lower than that of said first metal material, said head body having a front portion with a front surface, said face plate being embedded in said front portion of said head body such that said hitting surface of said face plate is flush with said front surface of said front portion;

whereby, said head body encloses each of said positioning pieces and said reinforcing strips during molding of said head body to result in a durable connection between said head body and said face plate.

2. The golf club head as claimed in claim 1, wherein each of said reinforcing strips is disposed in one of a horizontal, a vertical and an inclined direction.

3. The golf club head as claimed in claim 1, wherein at least one of said reinforcing strips has distal ends that extend radially outward from said peripheral edge of said face plate.

4. The golf club head as claimed in claim 1, wherein said positioning pieces and said reinforcing strips are welded onto said rear side of said face plate.

5. The golf club head as claimed in claim 1, further comprising a hosel welded to said rear side of said face plate.

* * * * *